US008250687B2

(12) United States Patent
Spidare et al.

(10) Patent No.: US 8,250,687 B2
(45) Date of Patent: Aug. 28, 2012

(54) PATIENT LIFT WITH ADJUSTABLE KNEE PADS AND SLING HOOKS

(75) Inventors: Frances Spidare, Copley, OH (US); Russell Pizzuto, Solon, OH (US); John Owens, Olmsted Township, OH (US); James Zhou, Jiangsu (CN); Roger Wang, Jiangsu (CN); Richard Li, Jiangsu (CN); Kenneth Chapman, Deltona, FL (US); Chris Jaeger, Grafton, OH (US)

(73) Assignee: Invacare Corporation, Elyria, OH (US)

( * ) Notice: Subject to any disclaimer, the term of this patent is extended or adjusted under 35 U.S.C. 154(b) by 110 days.

(21) Appl. No.: 12/537,385

(22) Filed: Aug. 7, 2009

(65) Prior Publication Data

US 2010/0031439 A1 Feb. 11, 2010

Related U.S. Application Data

(60) Provisional application No. 61/086,974, filed on Aug. 7, 2008.

(51) Int. Cl.
*A61G 7/10* (2006.01)

(52) U.S. Cl. ..... 5/87.1; 5/85.1; 5/89.1; 5/81.1 R

(58) Field of Classification Search ..... 5/87.1, 5/89.1, 83.1, 86.1, 81.1 R
See application file for complete search history.

(56) References Cited

U.S. PATENT DOCUMENTS

| | | | | |
|---|---|---|---|---|
| 1,901,377 | A | 3/1933 | Roe | |
| 3,962,737 | A | 6/1976 | James | |
| 3,996,632 | A | 12/1976 | Bakker | |
| 4,712,257 | A | 12/1987 | James | |
| D376,886 | S | 12/1996 | Dunn et al. | |
| 5,579,547 | A * | 12/1996 | Hunt | 5/86.1 |
| 5,892,180 | A * | 4/1999 | Carey | 5/86.1 |
| 6,201,195 | B1 * | 3/2001 | Carey | 177/144 |
| 6,270,101 | B1 | 8/2001 | Hase | |

(Continued)

FOREIGN PATENT DOCUMENTS

CA 2302060 9/2001

(Continued)

OTHER PUBLICATIONS

Invacare Corporation, Invacare Lifts and Slings brochure, 8 page brochure, copyright 2004.

(Continued)

*Primary Examiner* — Robert G Santos
*Assistant Examiner* — Brittany Wilson
(74) *Attorney, Agent, or Firm* — Calfee, Halter & Griswold LLP

(57) ABSTRACT

An apparatus is provided for lifting and transporting patients. The apparatus may include a base frame, a central frame, a knee pad, and a boom configured to pivot relative to the central frame. The knee pad may have a guide and a rail configured to travel within the guide to allow positioning and adjustment of the knee pad relative to the central frame. The guide may be configured to selectively secure the rail at any location within an adjustment range of the knee pad. The boom may have at least one hook portion for attachment of a device for holding the patient during lifting. The hook portion may include a hook formed from a curved portion of a central member and a clip attached to the curved portion and movable between a closed position and an open position.

28 Claims, 12 Drawing Sheets

U.S. PATENT DOCUMENTS

| | | | | |
|---|---|---|---|---|
| 6,675,412 | B2 * | 1/2004 | Faucher et al. | 5/83.1 |
| 6,806,430 | B2 * | 10/2004 | Downing | 5/86.1 |
| 7,634,824 | B2 * | 12/2009 | Gramkow et al. | 5/81.1 R |
| 7,654,593 | B2 * | 2/2010 | Hjort | 294/81.56 |
| 7,694,360 | B2 * | 4/2010 | Tally | 5/86.1 |
| 2005/0034231 | A1 * | 2/2005 | Huang | 5/86.1 |
| 2005/0273927 | A1 | 12/2005 | Tally | |
| 2006/0026755 | A1 | 2/2006 | Bain et al. | |
| 2006/0045708 | A1 | 3/2006 | Bain et al. | |
| 2006/0045709 | A1 | 3/2006 | Bain et al. | |
| 2006/0048297 | A1 | 3/2006 | Mills | |
| 2006/0165483 | A1 | 7/2006 | Moufflet | |
| 2009/0165204 | A1 * | 7/2009 | Biersteker et al. | 5/87.1 |
| 2010/0005585 | A1 | 1/2010 | Spidare | |
| 2010/0129148 | A1 | 5/2010 | Giannasca | |
| 2010/0162483 | A1 * | 7/2010 | Biersteker et al. | 5/87.1 |

FOREIGN PATENT DOCUMENTS

| | | |
|---|---|---|
| DE | 29720658 | 4/1999 |
| DE | 20303002 | 6/2003 |
| FR | 2140053 | 1/1973 |
| JP | 2005-111113 | 4/2005 |
| WO | 95/18592 | 7/1995 |
| WO | 2008/007222 | 1/2008 |
| WO | 2010/006240 | 1/2010 |

OTHER PUBLICATIONS

Sunrise Medical, Hoyer Pro, Arise for Independence brochure, 4 page brochure, copyright 2005.
ArjoHuntleigh, Maxi Sky600, The Complete, Customized Ceiling Lift System, 8 page brochure, May 2008.
Arjo, Tenor, A Safe Handling System for Bariatric Care, 12 page brochure, Apr. 2005.
Arjo, Sara 3000, Operating and Product Care Instructions, 20 page brochure, Jun. 2003.
Joerns Healthcare, Oxford/Hoyer, 3 page brochure, date unknown.
International Search Report and Written Opinion from PCT/US09/53083 dated Feb. 4, 2010.
Invacare Corporation, Owner's Operating and Maintenance Manual, Stand up Lift, Model RPS350-1, 60 pgs. dated Jan. 11, 2006.
International Search Report and Written Opinion from PCT/US09/050221, dated Oct. 15, 2009.
Invacare Lift and Slings brochure, 16 pgs, Invacare Corporation, copyright 2008.
Office Action from U.S. Appl. No. 12/500,855, dated Jun. 14, 2011.
Amendment/Response to Jun. 14, 2011 Office Action from U.S. Appl. No. 12/500,855, dated Sep. 1, 2011.
Office action from Australian Application No. 2009268484 dated Feb. 8, 2012.
Notice of Allowance from U.S. Appl. No. 12/500,855 dated Dec. 27, 2011.
Communication from European Application No. 09791264.6 dated Jan. 31, 2012.
Office action from New Zealand Application No. 590,353 dated Jan. 25, 2012.
Office action from New Zealand Application No. 590,594 dated Feb. 21, 2012.
Notice of Allowance from U.S. Appl. No. 12/500,855 dated Apr. 17, 2012.
Office action from Australian Application No. 2009279526 dated May 8, 2012.
Office Action from Australian Application No. 600412 dated Jun. 6, 2012.

* cited by examiner

PATIENT LIFT WITH ADJUSTABLE KNEE PADS AND SLING HOOKS

CROSS REFERENCE TO RELATED APPLICATION

This case claims priority to, and any other benefit of, U.S. Provisional Patent Application Ser. No. 61/086,974, filed on Aug. 7, 2008 and entitled Patient Lift with Adjustable Knee Pads and Sling Hooks, which is hereby incorporated by reference in its entirety.

FIELD OF THE INVENTION

The invention of the present application relates to an apparatus for lifting and transporting patients. More specifically, one exemplary embodiment of the invention described in the present application relates to an apparatus for lifting and transporting patients having adjustable knee pads and sling hooks.

BACKGROUND

Devices for lifting and transporting patients are an important tool for caregivers and medical staff. They prevent caregiver and staff injuries such as, for example, back and other related injuries, and ensure dignity in patient handling. Such devices are typically configured to allow for attachment of an accessory, such as for example, a foot plate, knee pads, or a weight scale. As such, these devices must be low maintenance, easy to use and safe for the caregiver and patient.

SUMMARY

An apparatus is provided for lifting and transporting patients. An exemplary embodiment of the apparatus includes: a base frame portion; a central frame portion connected to the base frame portion; a knee pad portion; and a boom portion configured to pivot relative to the central frame portion to lift the patient. The knee pad portion may have a guide portion and a rail portion configured to travel within the guide portion to allow positioning and adjustment of the knee pad portion relative to the central frame portion. The guide portion may be configured to selectively secure the rail portion at any location within an adjustment range of the knee pad portion. The boom portion may have a central member and at least one hook portion for attachment of a device for holding the patient during lifting. The hook portion may include a hook formed from a curved portion of the central member and a clip attached to the curved portion and movable between a closed position and an open position.

DESCRIPTION OF EMBODIMENTS

Figure 1A:
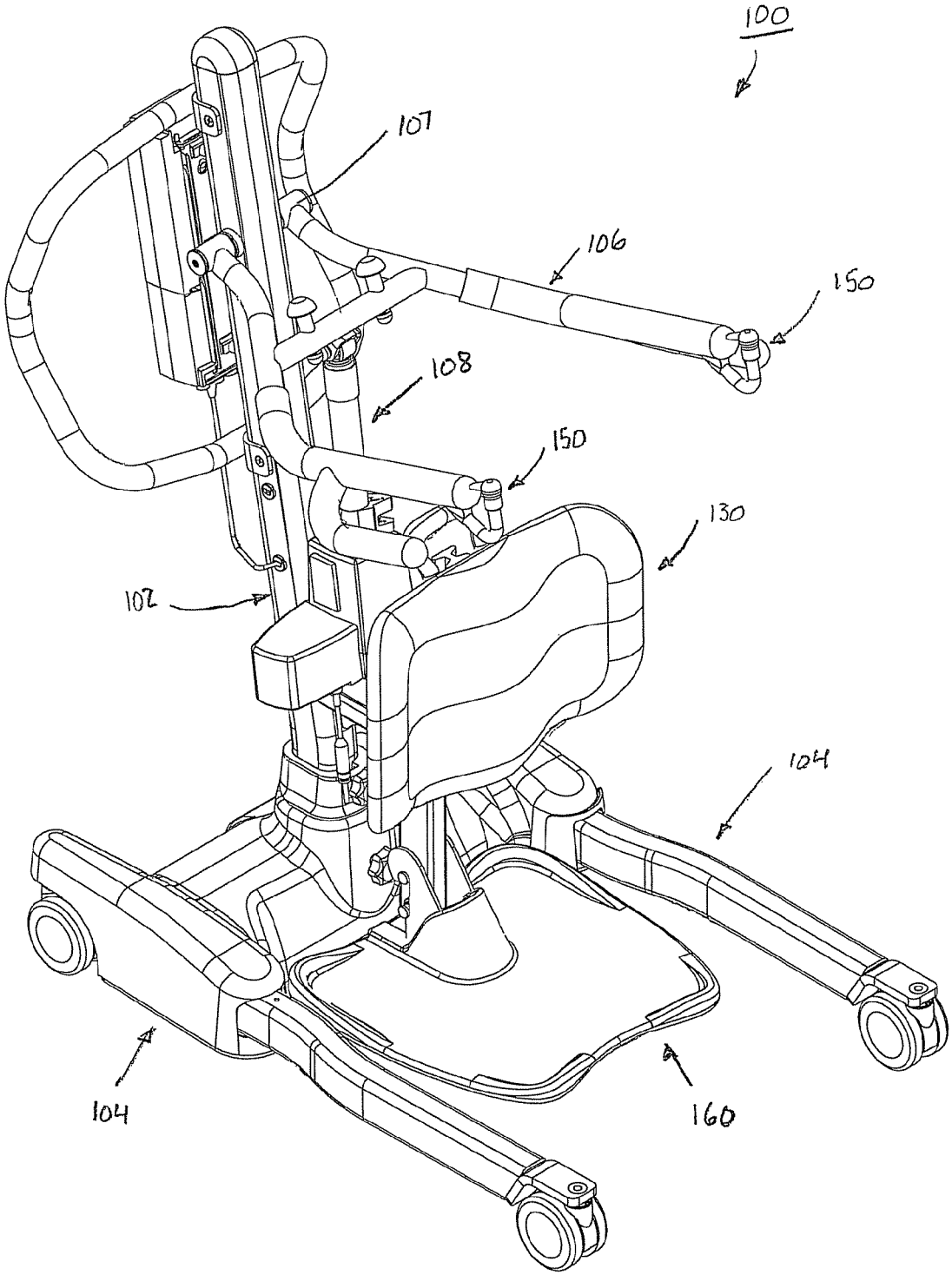
FIG. 1A is a perspective view of one embodiment of a patient lift apparatus.
Figure 1B:
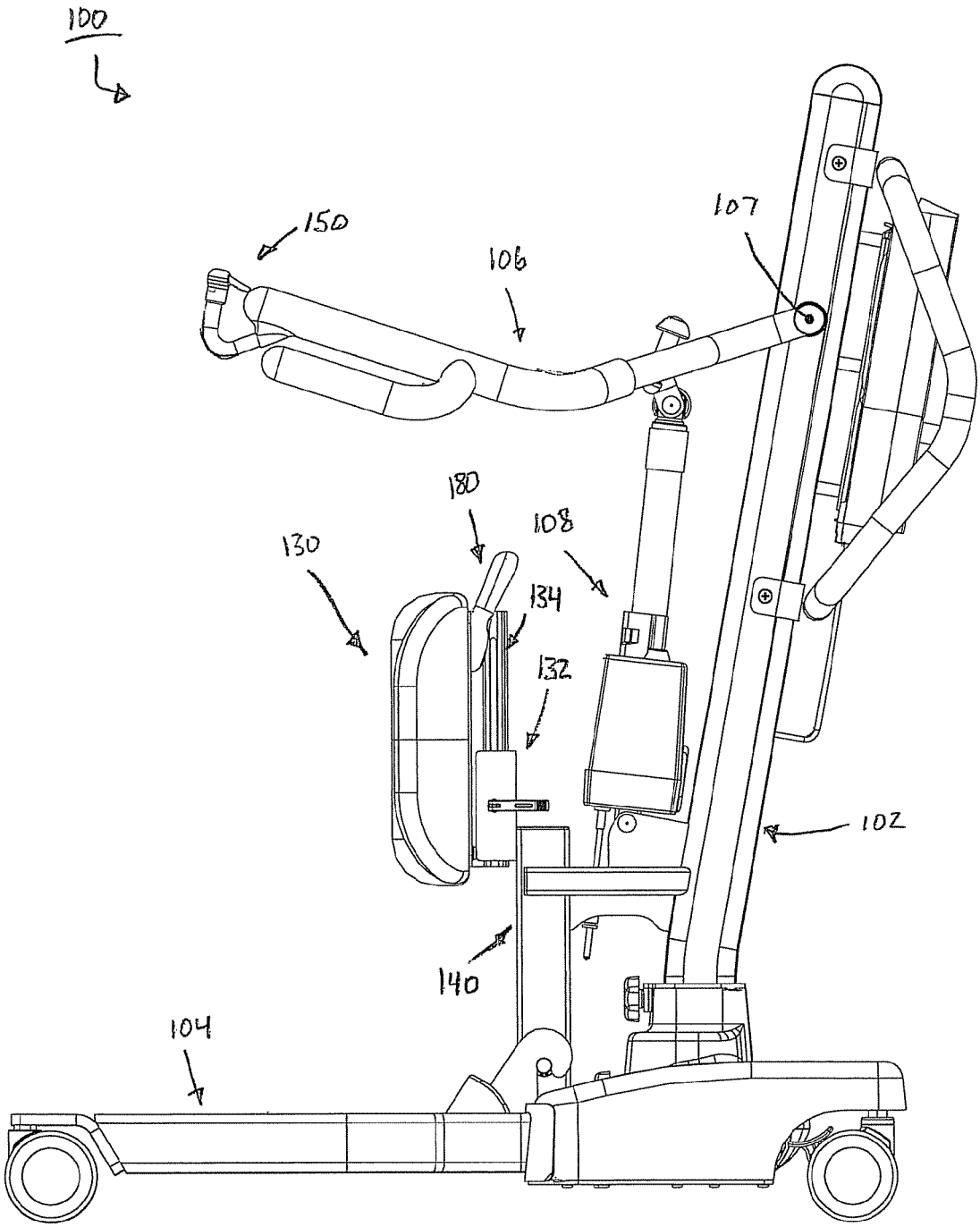
FIG. 1B is a side view of the patient lift apparatus of FIG. 1A.

FIGS. 1A-1B illustrate a perspective view and side view respectively of one embodiment of a patient lift apparatus 100. Apparatus 100 includes a central frame portion 102, base frame portion with caster leg assemblies 104, a boom portion 106, a knee pad portion 130, and a foot plate portion 160. Boom portion 106 is connected to central frame portion 102 through a pivot joint 107, which allows boom portion 106 to pivot with respect to central frame portion 102. An actuator 108 is provided to mechanically assist boom portion 106 to pivot about central frame portion 102. Actuator 108 can be, for example, an electrically driven screw-type, hydraulic, pneumatic or other similar type actuator. As described herein, when two or more objects are described as being connected, joined, affixed, or linked, they can be so connected, joined, affixed or linked directly to each other or through one or more intermediary parts or components.

Knee pad portion 130 further includes a rail portion 134 and a guide portion 132. Guide portion 132 is affixed to an accessory frame portion 140 extending from central frame portion 102. Guide portion 132 may be affixed to accessory frame portion 140 using any suitable means known in the art, such as for example, a weld, a fastener, an adhesive, or the like. Rail portion 134 travels within guide portion 132 to allow vertical positioning and adjustment of knee pad portion 130. Further, guide portion 132 may lock, or secure, rail portion 134 at any location within an adjustment range of knee pad portion 130. Knee pad portion 130 also includes a handle 180 attached to the knee pad of the knee pad portion. The handle 180 may be used by the user to position and adjust the knee pad portion 130. A user will generally grasp the handle 180 with one hand while using his or her other hand to lock or unlock the knee pad portion.

Boom portion 106 further includes hook portions 150. Hook portions 150 may be integrally formed with or connected to boom portion 106, such as for example, with a weld, a fastener, an adhesive, or the like. Further, it should be apparent to those skilled in the art that apparatus 100 may include one or more hook portions 150 positioned at various locations along boom portion 106. Attached to hook portions 150 is typically a sling (not shown) for holding a patient during lifting and transport.

Figure 2:
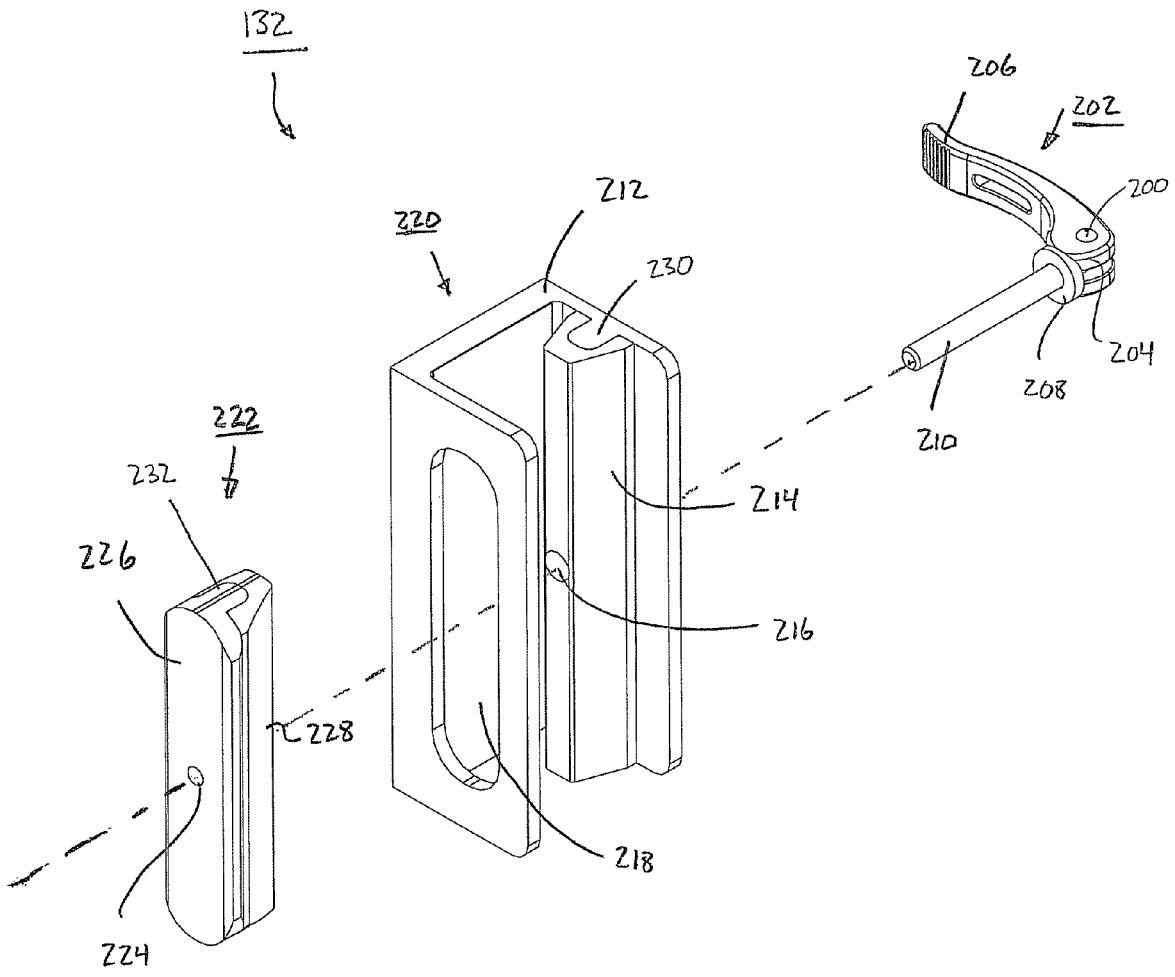
FIG. 2 is an exploded perspective view of one embodiment of a guide portion of a knee pad.

Referring now to FIG. 2, an exploded perspective view of guide portion 132 of knee pad portion 130 is shown. Guide portion 132 includes, for example, a pin portion 202, a sleeve portion 220, and a locking plate portion 222. Pin portion 202 includes a handle 206, a cam surface 204, a washer 208, a pin 200, and a shaft 210. Sleeve portion 220 includes a guide 212, a runner 214, an aperture 216, and a slot 218. Locking plate portion 222 includes a locking plate 226, a runner 228, and an aperture 224.

In the embodiment shown, pin portion 202 is designed to connect to locking plate portion 222 and manipulate the locking plate portion relative to sleeve portion 220. As shown, shaft 210 is pivotally attached to handle 206 by pin 200. However, shaft 210 may be pivotally attached to handle 206 by any suitable method known in the art, such as for example, with a hinge type connection. Further, shaft 210 extends through aperture 216 of sleeve portion 220. Aperture 216 is generally larger than the outer diameter of shaft 210 such that the shaft may move freely within the aperture.

Shaft 210 is also removably connected to locking plate portion 222. For example, shaft 210 and aperture 224 may form a threaded connection. Further, shaft 210 may extend through locking plate 226 and include a fastener, such as for example, a nut, cotter pin, or the like, at a distal portion of the shaft to hold locking plate portion 222 on the shaft. However, it should be apparent to those skilled in the art that other methods of removably connecting shaft 210 to locking plate portion 222 are known and may be used in the practice of this invention.

In the embodiment shown, shaft 210 must be removable from locking plate portion 222 and guide portion 132 disassembled to remove knee pad portion 130 from apparatus 100. However, in other embodiments (described below), shaft 210 is not required to be removable from locking plate portion 222 to allow knee pad portion 130 to be removed from apparatus 100. In these embodiments, shaft 210 may be connected to locking plate portion 222 by any suitable method known in the art, such as for example, with a weld or adhesive.

Still referring to FIG. 2, slot 218 in sleeve portion 220 is designed to guide the axial movement of locking plate portion 222 relative to the sleeve portion. As such, slot 218 may be any suitable size and shape known in the art capable of guiding the movement of locking plate portion 222 relative to sleeve portion 220. Further, the sides, or walls, of guide 212 may be various sizes and shapes known in the art that allow rail portion 134 to travel within guide portion 132 and the guide portion to lock, or secure, the rail portion at various locations within the adjustment range.

In the embodiment shown, runner 214 is attached to a ridge 230, or raised portion, of guide 212. Similarly, runner 228 is attached to a ridge 232, or raised portion, of locking plate 226. Runners 214, 228 may attach to ridges 230, 232 by any suitable means known in the art, such as for example, with a snap fit, an adhesive, or fastener. Further, runners 214, 228 may be integrally formed or over-molded with guide 212 or locking plate 226 respectively. As shown, runners 214, 228 are made of nylon to provide for smooth operation as rail portion 134 travels within guide portion 132. However, it should be apparent to those skilled in the art that other materials may be used, such as for example, rubber, plastic, or metal.

Figure 3:
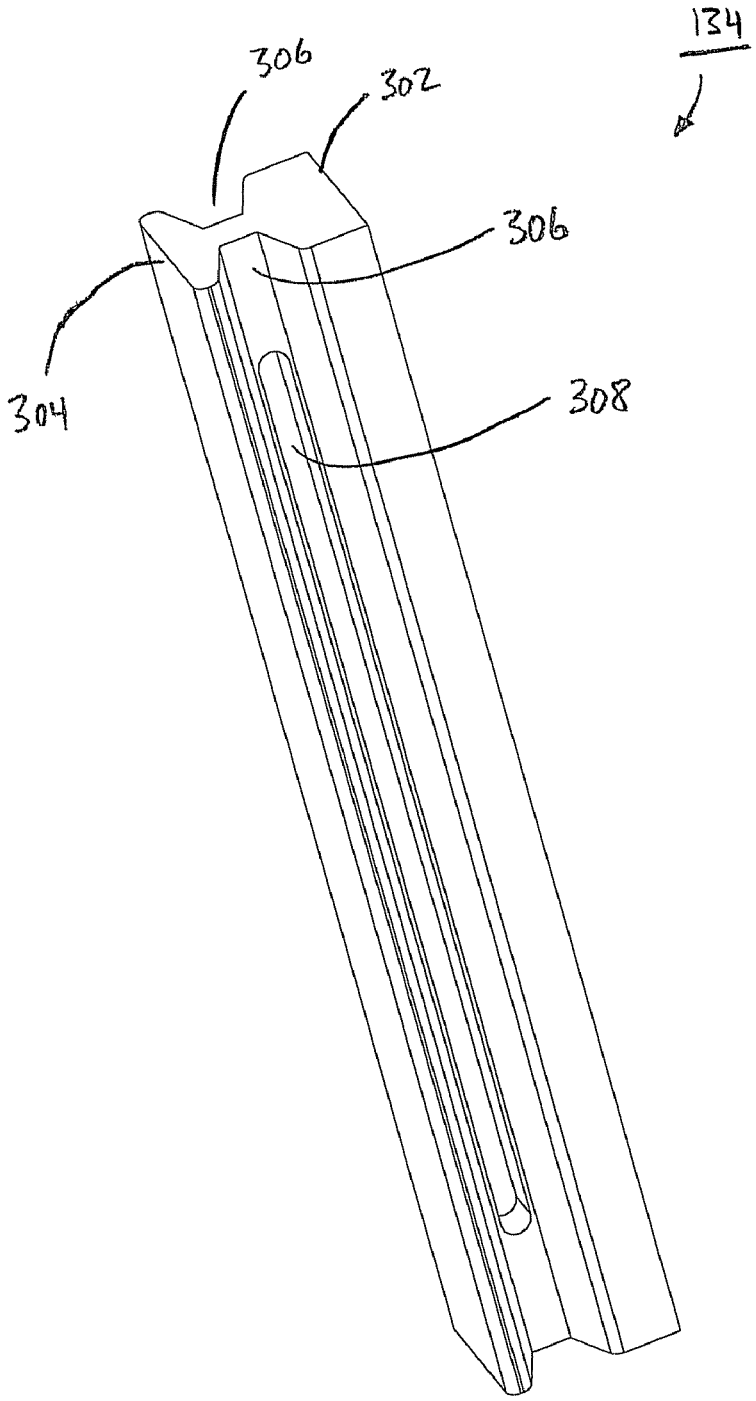
FIG. 3 is a perspective view of one embodiment of a rail portion of a knee pad.

Referring now to FIG. 3, a perspective view of rail portion 134 of knee pad portion 130 is shown. Rail portion 134 is defined by a base 302, a top 304, and two longitudinal channels 306. Further, a longitudinal slot 308 extends through rail portion 134 at the bottom of longitudinal channels 306. Shaft 210 of guide portion 132 extends through longitudinal slot 308 when knee pad portion 130 is connected to apparatus 100. As shown, longitudinal slot 308 does not extend to either end of rail portion 134. However, in some embodiments (not shown), slot 308 extends to one end of rail portion 134. As such, guide portion 132 would not need to be disassembled to allow knee pad portion 130 to be removed from apparatus 100.

Figure 4:
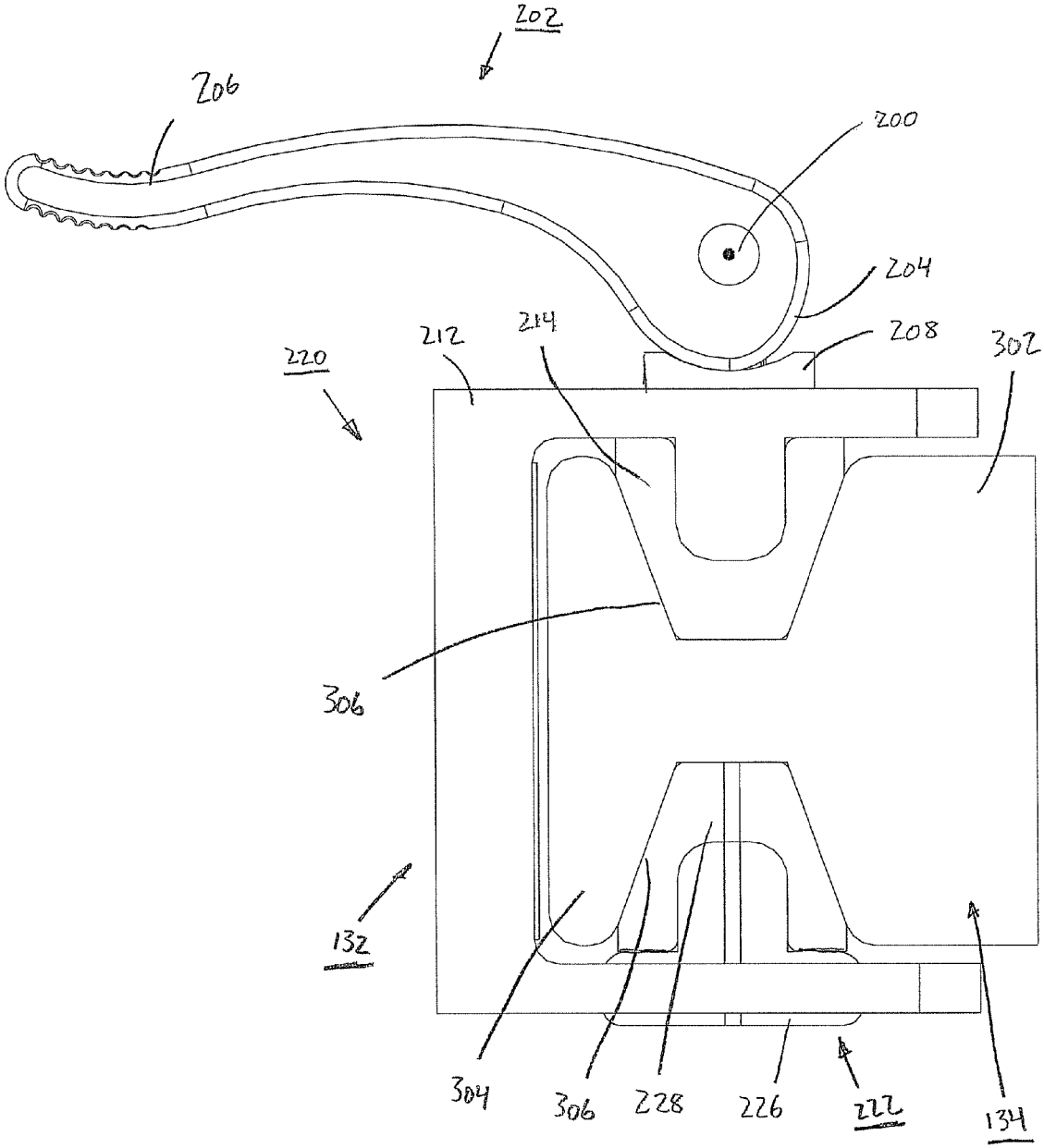
FIG. 4 is a top plan view of one embodiment of a rail portion within a guide portion.

Referring now to FIG. 4, a top plan view of rail portion 134 within guide portion 132 is shown. As shown, guide portion 132 is locked, or secured, to rail portion 134. In the locked position, runners 214, 228 are pressed against longitudinal channels 306 to create a friction lock. As shown, the cross sectional shape of runners 214, 228 is substantially similar to the cross sectional shape of longitudinal channels 306. As such, the three sides of runners 214, 228 press against the three sides of longitudinal channels 306 to create the friction lock. However, the cross sectional shape of runners 214, 228 and longitudinal channels 306 may be various suitable shapes known in the art, such as for example, at least partially curved or square, and need not be substantially similar.

In the embodiment shown, handle 206 is in the locked position. As the user rotates handle 206 about pin 200 into the locked position, cam surface 204 presses against washer 208 and pulls shaft 210 and locking plate portion 222 towards the handle. As such, handle 206 acts as a lever, providing a mechanical advantage to the user and pulling locking plate portion 222 against rail portion 134 to create the friction lock. Cam surface 204 allows handle 206 to remain in the locked position and hold locking plate portion 222 against rail portion 134 until the user rotates the handle to the unlocked position (not shown). In the unlocked position, locking plate portion 222 is released and rail portion 134 is free to travel within guide portion 132.

Handle 206 may be operated to create the friction lock with one hand. As such, knee pad portion 130 may be easily and quickly adjusted by one person without the use of tools or the need to align pins or bolts with holes in the rail portion and/or guide portion. Further, guide portion 132 may lock, or secure, rail portion 134 at any location (i.e., an infinite number of locations) within the adjustment range of knee pad portion 130. Further, in the embodiment shown, guide portion 132 cannot be removed from rail portion 134 without disassembling the guide portion, reducing the chances of a knee pad assembly getting lost at a treatment facility.

Figure 5:
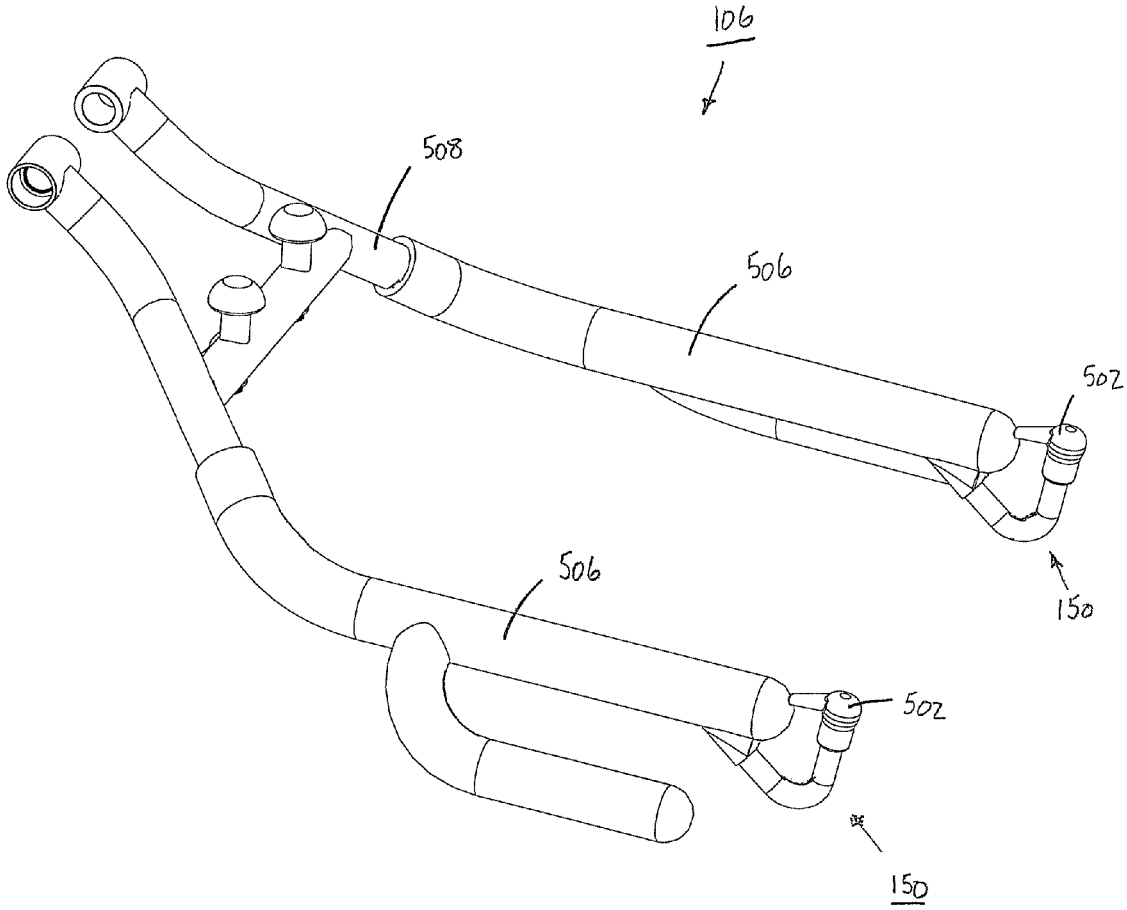
FIG. 5 is a perspective view of one embodiment of a boom portion.

Referring now to FIG. 5, a perspective view of boom portion 106 is shown. As shown, boom portion 106 further includes hook portions 150. Each hook portion 150 includes a cap 502 removably attached to a hook integrally formed with a central member 508 of boom portion 106. As shown, central member 508 is at least partially covered with a protective covering 506.

Although the hooks of hook portions 150 are formed as part of central member 508, the hooks may be connected to boom portion 106, such as for example, with a weld, a fastener, an adhesive, or the like. Further, it should be apparent to those skilled in the art that boom portion 106 may include one or more hook portions 150 positioned at various locations along the boom portion. Attached to hook portions 150 is typically a sling (not shown) for holding a patient during lifting and transport. As shown, the orientation of hook portions 150 prohibit the sling from coming off of the hook when the boom portion 106 is pivoted to lift the patient.

Figure 6:
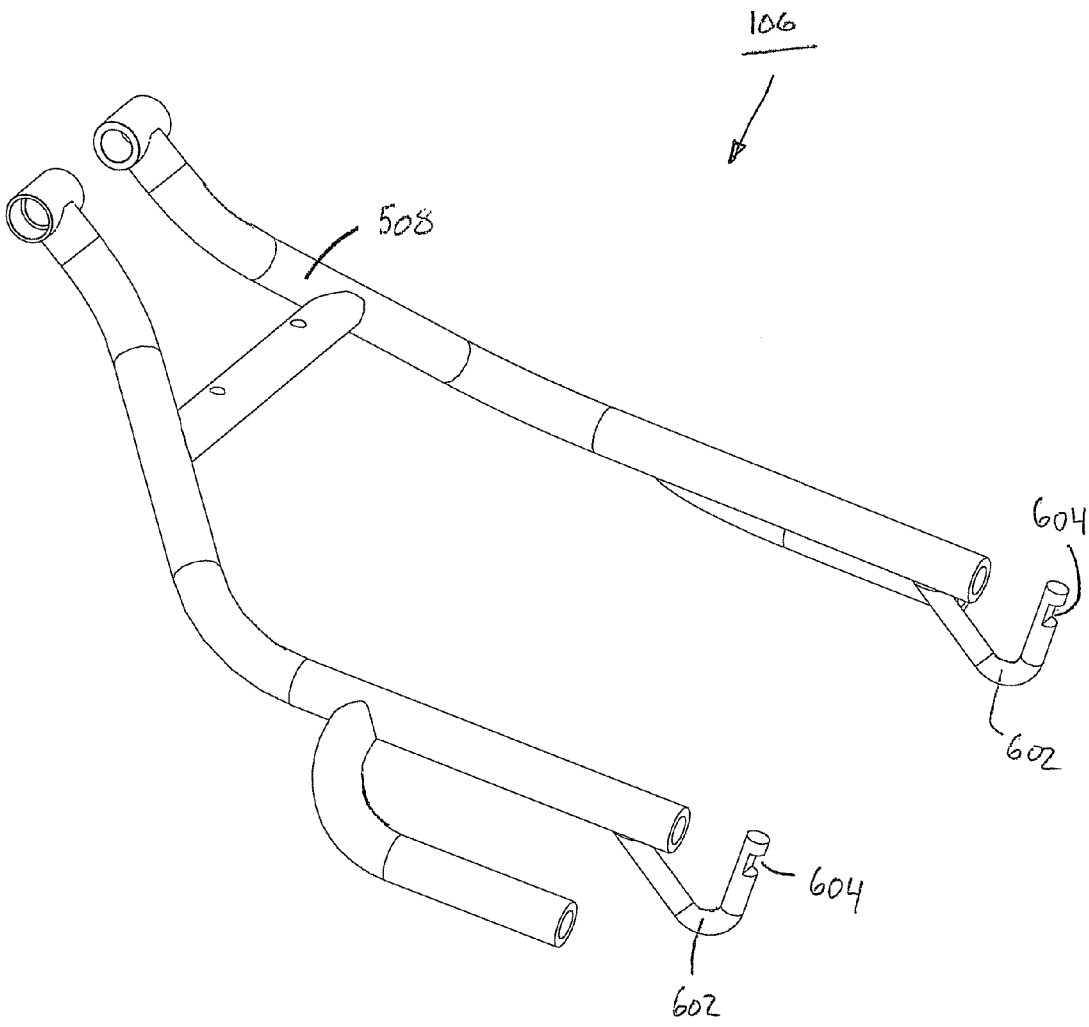
FIG. 6 is a perspective view of a central member of the boom portion of FIG. 5.

Referring to FIG. 6, central member 508 is shown without protective covering 506. As shown, central member 508 includes a curved portion 602 that forms the hook. A notch 604 is disposed towards the end of curved portion 602. Notch 604 is designed to mate with cap 502 to secure the cap to central member 508 of boom portion 106.

Figure 7A:
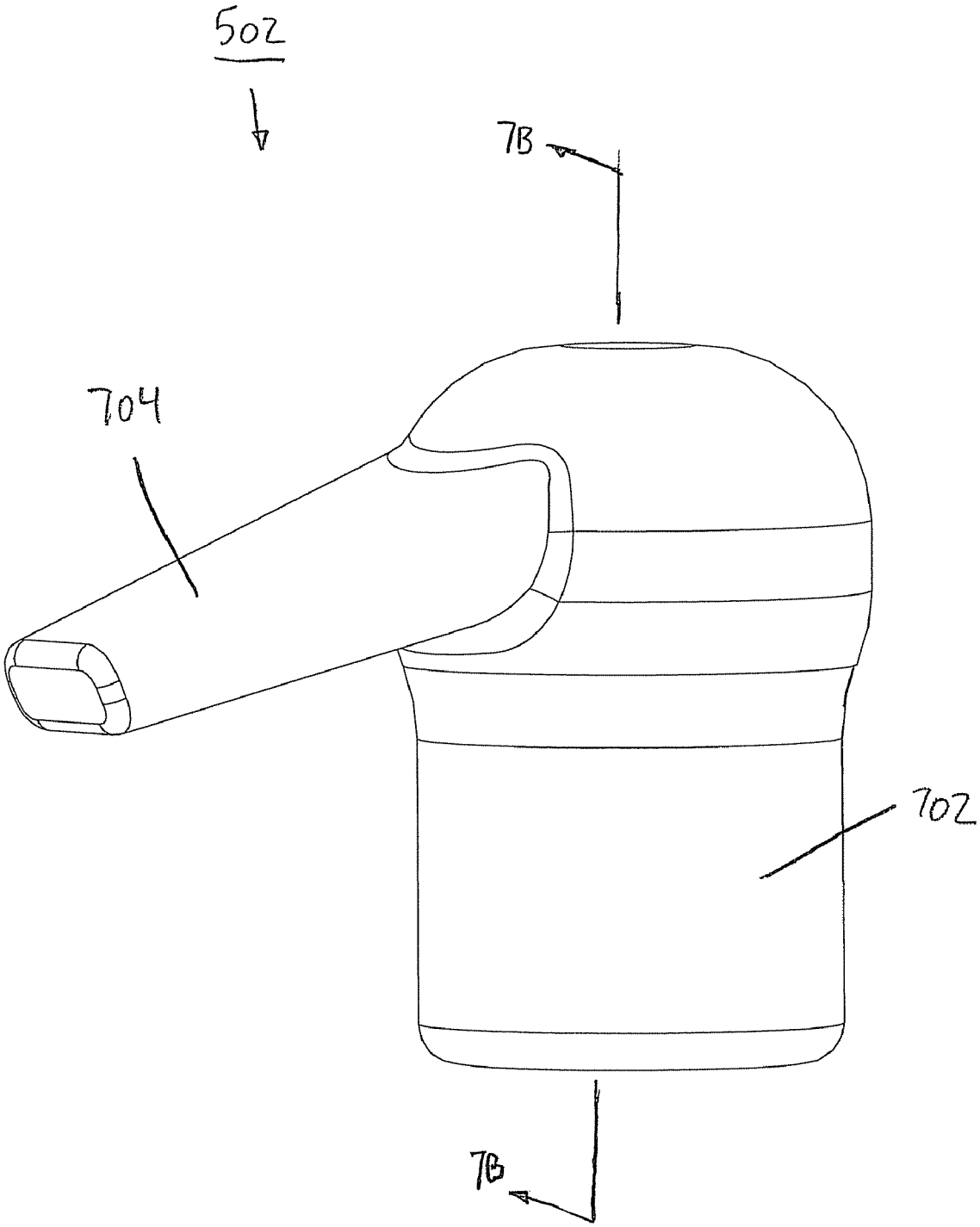
FIG. 7A is a perspective view of one embodiment of a cap.
Figure 7B:
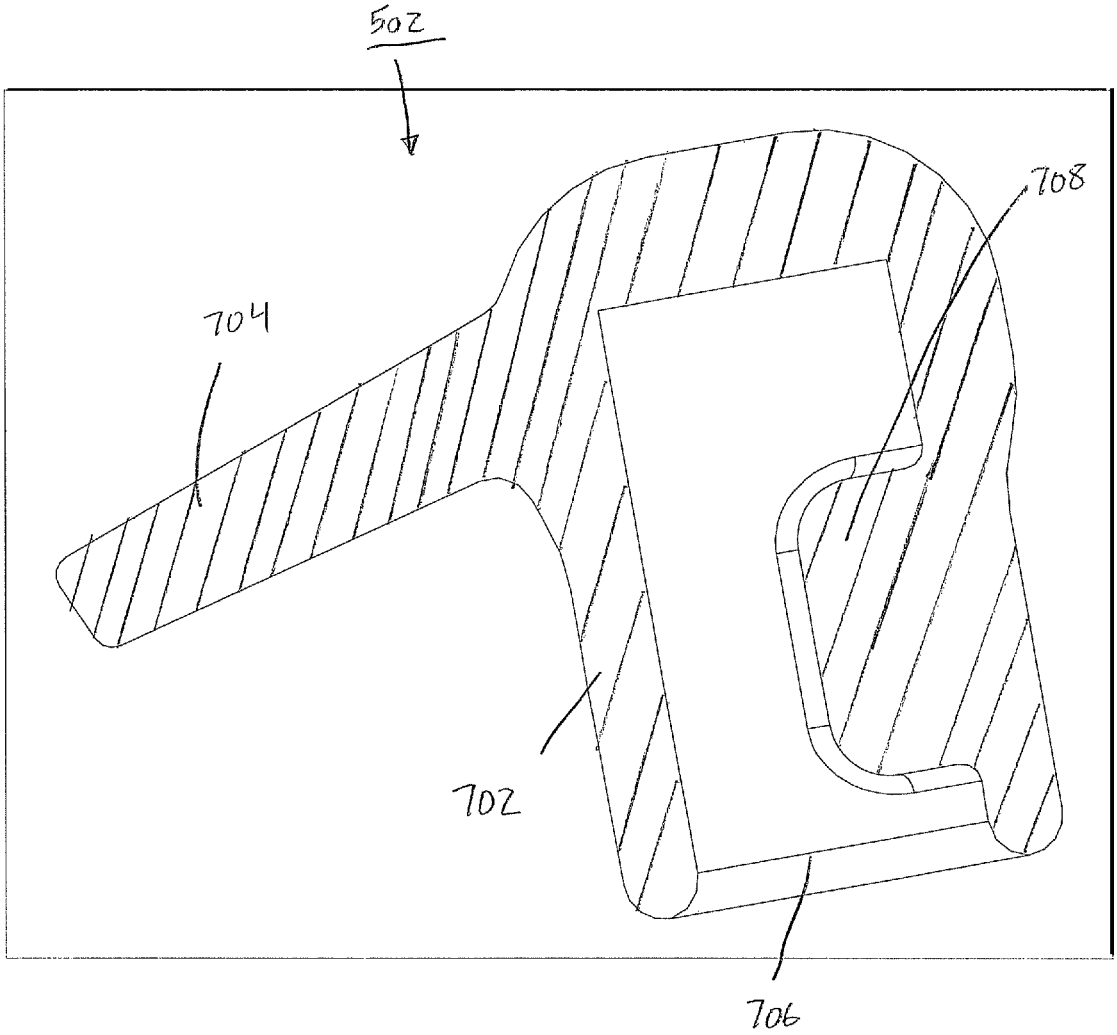
FIG. 7B is a cross sectional view of the cap of FIG. 7A.

Referring to FIGS. 7A and 7B, a perspective view and cross sectional view of cap 502 is shown respectively. Cap 502 includes a main body portion 702 and a clip portion 704. Clip portion 704 is designed to prohibit the sling from coming off the hook by generally closing the opening between cap 502 and central member 508. Further, clip portion 704 is designed to move at least upwards and downwards (i.e., bidirectional) such that the sling may be easily attached and released from hook portions 150. Clip portion 704 may vary in shape, such as for example, straight or arcuate. Further, in some embodiments (not shown), clip portion 704 may interact with central member 508 to create a positive lock.

As shown in FIG. 7B, cap 502 further includes an interior cavity 706. Interior cavity 706 is designed such that cap 502 may removably attach to curved portion 602 of central member 508. A ridge 708, or raised portion, on the inner surface of interior cavity 706 is configured to mate with notch 604 disposed towards the end of curved portion 602 and prohibit cap 502 from coming off central member 508.

In the embodiment shown, cap 502 is made of an elastomeric material such that clip portion 704 biases back to a stable, or neutral, position. In some embodiments, biased clip portion 704 may apply a force against central member 508. The configuration of clip portion 704 is one way to create the biasing effect. Exemplary clip portion configurations include combinations of material, such as for example, an elastomer, and shape. However, it should be apparent that any biasing method or structure may be used to practice this invention, such as for example, a spring. Further, the elastomeric material is quiet so as to not disturb others in the treatment facility and forms a relatively safe cover for cushioning any potential impacts or bumps with hook portions 150. However, cap 502 may be made from other suitable materials known in the art, such as for example, molded or stamped plastic, a stamped metal, or a wire form.

Figure 8A:
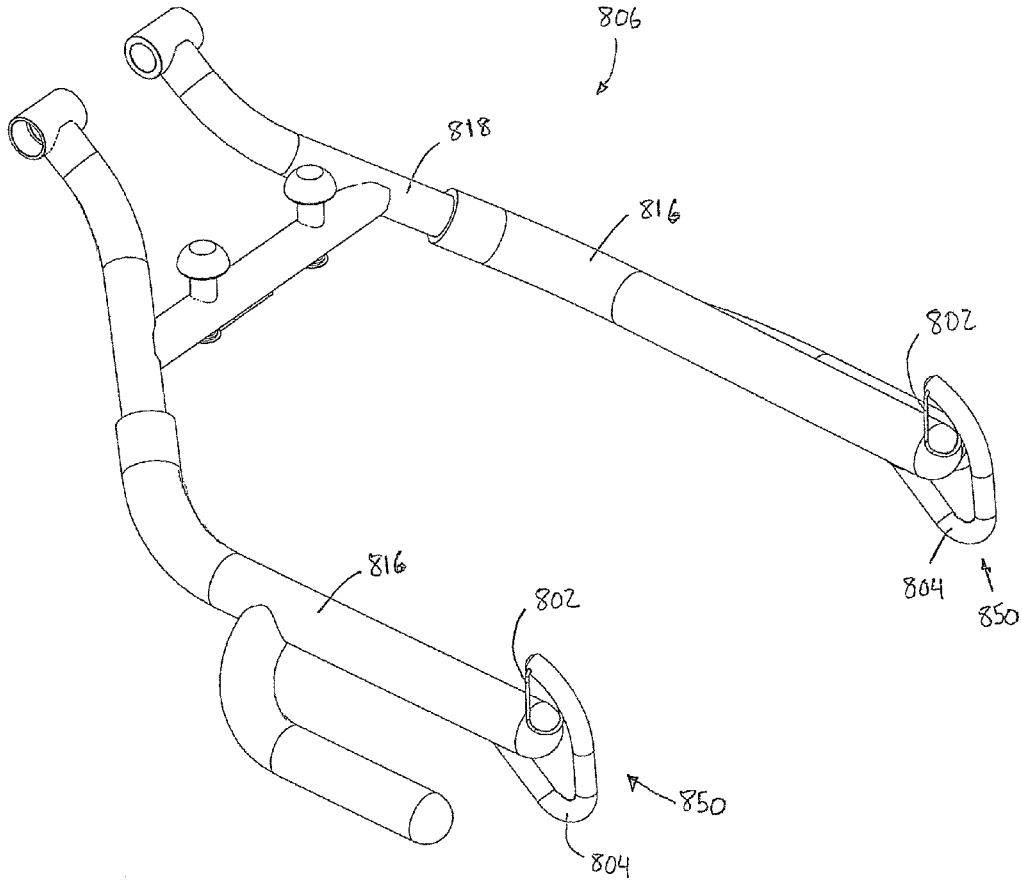
FIG. 8A is a perspective view of one embodiment of a boom portion.
Figure 8B:
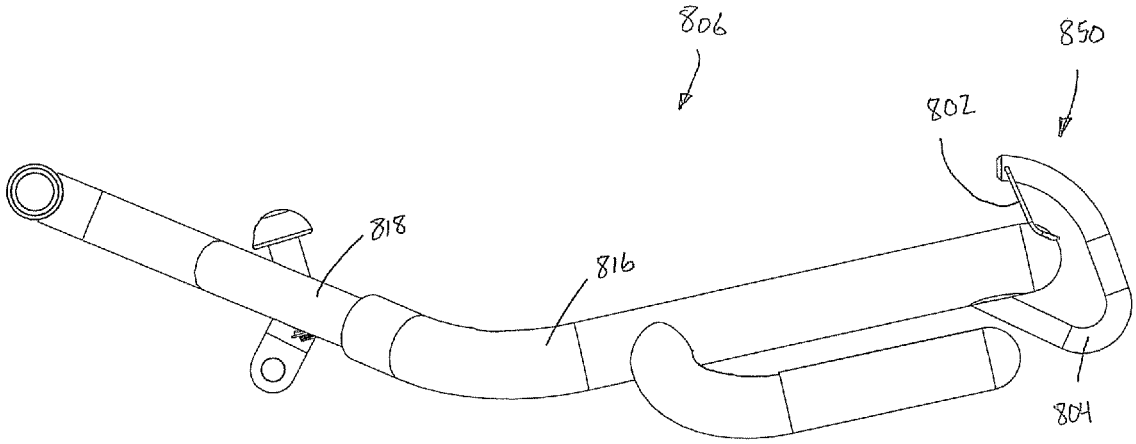
FIG. 8B is a side view of the boom portion of FIG. 8A.

Referring now to FIGS. 8A and 8B, a perspective view and a side view of a boom portion 806 is shown respectively. As shown, boom portion 806 includes a central member 818 at least partially covered with a protective covering 816. Boom portion 806 further includes hook portions 850. Each hook portion 850 includes a clip 802 pivotally attached to a hook integrally formed with central member 818.

Central member 818 includes curved portions 804 that form the hooks of hook portions 850. Each curved portion 804 at least partially surrounds a rounded end of protective covering 816 of boom portion 806. As shown in FIG. 8B, each curved portion 804 extends at an angle downward and away from boom portion 806 and then curves upward and back towards boom portion 806. Clip 802 of hook portion 850 extends from an end of curved portion 804 to generally close the opening between the curved portion and the end of protective covering 816.

Although the hooks of hook portions 850 are formed as part of central member 818, the hooks may be connected to boom portion 806, such as for example, with a weld, a fastener, an adhesive, or the like. Further, it should be apparent to those skilled in the art that boom portion 806 may include one or more hook portions 850 positioned at various locations along the boom portion. Attached to hook portions 850 is typically a sling (not shown) for holding a patient during lifting and transport. As shown, the orientation of hook portions 850 prohibit the sling from coming off of the hook when the boom portion 806 is pivoted to lift the patient.

Figure 8C:
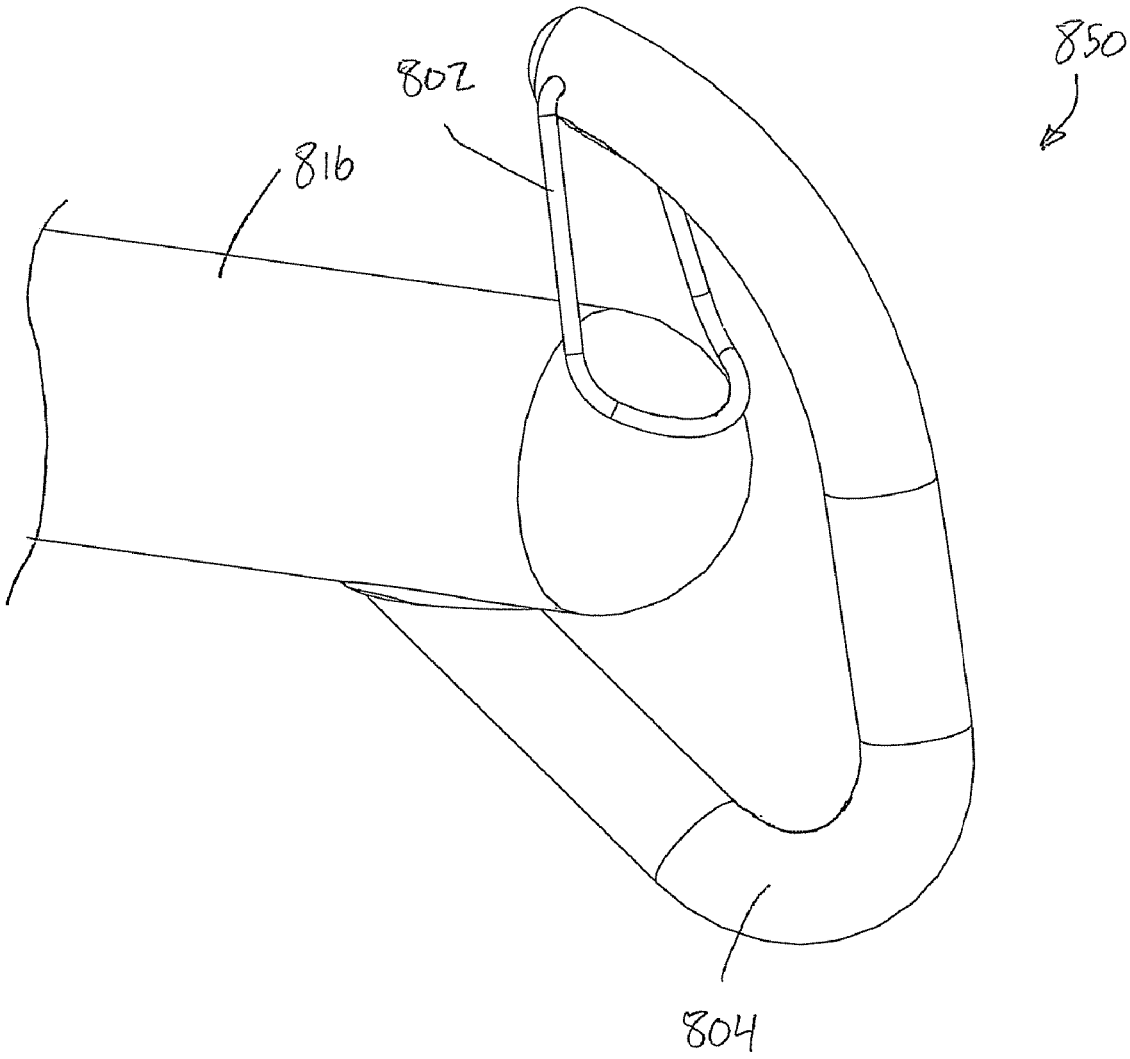
FIG. 8C is a perspective view of a hook portion of the boom portion of FIG. 8A.

Referring to FIG. 8C, a perspective view of hook portion 850 is shown. Clip 802 of hook portion 850 is designed to prohibit the sling from coming off the hook by generally closing the opening between the hook and the end of protective covering 816. As shown, clip 802 is a wire form loop pivotally attached to an end of the hook. A portion of clip 802 that contacts the rounded end of protective covering 816 is curved to conform to the shape of the rounded end and at least partially wrap around the end of the protective covering. However, clip 802 may vary in shape, such as for example, the clip may include a substantially straight or curved body that extends between the hook and the end of protective covering 816. Clip 802 may also be made from other suitable materials, such as for example, molded or stamped plastic or a stamped metal. Further, in some embodiments, clip 802 may interact with protective covering 816 and/or central member 818 to create a positive lock.

Further, clip 802 is designed to move at least front and back (i.e., bidirectional) such that the sling may be easily attached and released from hook portions 850. As shown in FIG. 8C, clip 802 is closed and in a stable, or neutral, position. During attachment of the sling to hook portion 850, clip 802 pivots back and away from protective covering 816 to open the gap between the hook and the protective covering. Once the sling passes by clip 802, the clip pivots forward and back to the closed position to close the gap between the hook and protective covering 816. In the closed position, clip 802 prohibits the sling from coming off of the hook, or disengaging, when boom portion 806 is pivoted to lift the patient.

As shown in FIGS. 8A-8C, clip 802 is a gravity clip. Hook portions 850 are configured such that gravity biases clip 802 towards the closed position. Further, the configuration of the hook portions 850 permits clip 802 to be held in the closed position as boom portion 806 is pivoted to lift the patient. In other embodiments, clip 802 may be biased towards the closed position by other methods and may apply a force against protective covering 816. Exemplary clip configurations include combinations of material, such as for example, an elastomer, and shape. However, it should be apparent that any biasing method or structure may be used, such as for example, a spring.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

We claim:

1. An apparatus for lifting and transporting patients, comprising:

a base frame portion;

a central frame portion connected to the base frame portion;

a boom portion configured to pivot relative to the central frame portion to lift the patient; and a knee pad portion having a guide portion and a rail portion configured to travel within the guide portion to allow positioning and adjustment of the knee pad portion relative to the central frame portion, wherein the guide portion is configured to selectively secure the rail portion at any location within an adjustment range of the knee pad portion; and wherein the guide portion comprises a pin portion, a sleeve portion, and a locking plate portion, the pin portion connected to the locking plate portion and configured to selectively manipulate the locking plate portion relative to the sleeve portion; and wherein the sleeve portion and the locking plate portion are configured to press against longitudinal channels of the rail portion when the knee pad portion is in a locked position to secure the rail portion relative to the guide portion.

2. The apparatus of claim 1, wherein the knee pad portion is configured for positioning and adjustment without the use of tools or the need to align pins or bolts with holes in the rail portion or the guide portion.

3. The apparatus of claim 1, wherein the sleeve portion comprises a slot configured to guide the axial movement of the locking plate portion relative to the sleeve portion.

4. The apparatus of claim 1, wherein the sleeve portion and the locking plate portion each comprise at least one runner.

5. The apparatus of claim 4, wherein in the locked position, each runner is pressed against one of the longitudinal channels of the rail portion to secure the rail portion relative to the guide portion.

6. The apparatus of claim 1, wherein a shaft of the pin portion extends through an aperture of the sleeve portion and a longitudinal slot of the rail portion and is removably connected to the locking plate portion.

7. The apparatus of claim 6, wherein the shaft of the pin portion is pivotally connected to a handle.

8. The apparatus of claim 7, wherein the handle acts a lever when a user rotates the handle from an unlocked position to a locked position by pulling the locking plate portion against the rail portion to secure the rail portion relative to the guide portion.

9. The apparatus of claim 8, wherein the locking plate portion is held against the rail portion in the locked position until the user rotates the handle to the unlocked position.

10. The apparatus of claim 7, wherein the handle comprises a cam surface and is configured for one hand operation.

11. The apparatus of claim 10, wherein the cam surface of the handle presses against the sleeve portion and pulls the locking plate portion against the rail portion to secure the rail portion relative to the guide portion.

12. The apparatus of claim 1, wherein the guide portion is attached to an accessory frame portion extending from the central frame portion.

13. The apparatus of claim 1, wherein the boom portion further comprises a central member and at least one hook portion for attachment of a device for holding the patient during lifting, and wherein the at least one hook portion comprises a hook formed from a curved portion of the central member and a clip attached to the curved portion and movable between a closed position and an open position.

14. An apparatus for lifting and transporting patients, comprising:

a base frame portion;

a central frame portion connected to the base frame portion; and a boom portion having a central member and at least one hook portion for attachment of a device for holding the patient during lifting, wherein the boom portion is configured to pivot relative to the central frame portion to lift the patient; and wherein the at least one hook portion comprises a hook formed from a curved portion of the central member and a clip attached to the curved portion and movable between a closed position and an open position, wherein the curved portion extends at an angle downward and away from the boom portion and then transitions upward beyond an end of the boom portion to form the hook;

wherein in the closed position, the clip generally closes an opening between the hook and the end of the boom portion and prohibits the device from coming off the hook when the boom portion is pivoted to lift the patient; and wherein in the open position, the clip permits attachment of the device to the at least one hook portion.

15. The apparatus of claim 14, wherein the curved portion of the central member at least partially surrounds the end of the boom portion.

16. The apparatus of claim 14, wherein the curved portion extends at an angle downward and away from the boom portion and then curves upward and back towards the boom portion.

17. The apparatus of claim 14, wherein the central member of the boom portion is at least partially covered with a protective covering and the clip generally closes an opening between the hook and a rounded end of the protective covering.

18. The apparatus of claim 17, wherein the clip is a wire loop pivotally attached to an end of the curved portion.

19. The apparatus of claim 18, wherein a portion of the clip that contacts the rounded end of the protective covering is curved to conform to the shape of the rounded end and at least partially wrap around the rounded end.

20. The apparatus of claim 14, wherein the at least one hook portion is configured such that gravity biases the clip towards the closed position.

21. The apparatus of claim 20, wherein the clip is held in the closed position as the boom portion is pivoted to lift the patient.

22. The apparatus of claim 14 further comprising a first hook portion and a second hook portion, each hook portion comprising a hook formed from a curved portion of the central member and a clip attached to the curved portion and movable between a closed position and an open position.

23. The apparatus of claim 14, wherein the clip is integrally formed with a cap attached to an end of the curved portion.

24. The apparatus of claim 23, wherein the clip is made from an elastomeric material and is biased towards the closed position and remains in the closed position as the boom portion is pivoted to lift the patient.

25. The apparatus of claim 14 further comprising a knee pad portion having a guide portion and a rail portion configured to travel within the guide portion to allow positioning and adjustment of the knee pad portion relative to the central frame portion, wherein the guide portion is configured to selectively secure the rail portion at any location within an adjustment range of the knee pad portion.

26. An apparatus for lifting and transporting patients, comprising:

a base frame portion;

a central frame portion connected to the base frame portion;

a knee pad portion having a guide portion and a rail portion configured to travel within the guide portion to allow positioning and adjustment of the knee pad portion relative to the central frame portion, wherein the guide portion is configured to selectively secure the rail portion at any location within an adjustment range of the knee pad portion, and wherein the guide portion comprises a pin portion, a sleeve portion, and a locking plate portion, the pin portion connected to the locking plate portion and configured to selectively manipulate the locking plate portion relative to the sleeve portion, and wherein the sleeve portion and the locking plate portion are configured to press against longitudinal channels of the rail portion when the knee pad portion is in a locked position to secure the rail portion relative to the guide portion; and a boom portion having a central member and at least one hook portion for attachment of a device for holding the patient during lifting, wherein the boom portion is configured to pivot relative to the central frame portion to lift the patient; and wherein the at least one hook portion comprises a hook formed from a curved portion of the central member and a clip attached to the curved portion and movable between a closed position and an open position.

27. An apparatus for lifting and transporting patients, comprising:

a base frame portion;

a central frame portion connected to the base frame portion; and a boom portion configured to pivot relative to the central frame portion to lift the patient, wherein the boom portion comprises a central member and at least one hook portion for attachment of a device for holding the patient during lifting, and wherein the at least one hook portion comprises a hook formed from a curved portion of the central member and a cap attached to an end of the curved portion; and wherein the curved portion extends at an angle downward and away from the boom portion and then transitions upward to form the hook; and wherein the cap comprises a clip movable between a closed position and an open position, and wherein in the closed position, the clip generally closes an opening between the hook and an end of the boom portion and prohibits the device from coming off the hook when the boom portion is pivoted to lift the patient, and wherein in the open position, the clip permits attachment of the device to the at least one hook portion.

28. The apparatus of claim 27, wherein the clip is made from an elastomeric material and is biased towards the closed position and remains in the closed position as the boom portion is pivoted to lift the patient.

* * * * *